US005743461A

United States Patent [19]

Timmins

[11] Patent Number: 5,743,461

[45] Date of Patent: Apr. 28, 1998

[54] SHIPPING CONTAINER

[75] Inventor: Lawrence J. Timmins, Riverview, Mich.

[73] Assignee: Chrysler Corporation, Auburn Hills, Mich.

[21] Appl. No.: 791,442

[22] Filed: Jan. 27, 1997

[51] Int. Cl.[6] ..... B65D 5/42

[52] U.S. Cl. ..... 229/125.39; 206/386; 229/125.37

[58] Field of Search ..... 229/125.37, 125.39, 229/125.41, 126; 292/288; 24/546, 561, 563, 570, 910; 206/386, 596, 598, 599, 600

[56] References Cited

U.S. PATENT DOCUMENTS

| | | | |
|---|---|---|---|
| 933,454 | 9/1909 | Hudson | 229/125.39 |
| 1,423,936 | 7/1922 | Huffman | 229/125.39 |
| 2,828,905 | 4/1958 | Frizzell | 229/125.39 |
| 2,879,097 | 3/1959 | Hendee | 229/125.41 |
| 3,189,250 | 6/1965 | Haygeman | 229/125.39 |
| 3,221,977 | 12/1965 | Pollert | 229/125.39 |
| 3,276,663 | 10/1966 | Falconer | 229/125.39 |
| 3,345,920 | 10/1967 | Jordan | 229/125.39 |
| 3,442,434 | 5/1969 | Simas | 206/598 |
| 3,995,736 | 12/1976 | Lawson et al. | 206/386 |
| 4,761,935 | 8/1988 | King et al. | 229/125.39 |

FOREIGN PATENT DOCUMENTS

| | | | |
|---|---|---|---|
| 2032486 | 2/1972 | Germany | 229/125.37 |
| 2458725 | 6/1975 | Germany | 229/125.39 |

*Primary Examiner*—Gary E. Elkins
*Attorney, Agent, or Firm*—Lawrence J. Shurupoff

[57] ABSTRACT

A rectangular shipping container of corrugated cardboard in which the bottom is closed by first and second closure flaps hingedly connected to the lower edges of the side walls, and third and fourth closure flaps hingedly connected to the lower edges of the end walls. The first and second flaps are foldable inwardly to horizontal positions closing the bottom of the container in which their inner edges are closely spaced apart and define a channel. The third and fourth flaps are slotted and are foldable inwardly to horizontal positions in which they underlie the first and second flaps and their slots underlie the channel. A first retainer is slidable in the channel and in the slot in one of the slotted flaps, engaging the first and second flaps and the slotted flap to hold them in their horizontal positions. A second retainer is slidable in the channel and in the slot in the other slotted flap, engaging the first and second flaps and the other slotted flap to hold them in their horizontal positions. The retainers are slidable in the channel toward one another far enough to withdraw from the slots and then slidable out of the channel through either end thereof to release all of the flaps.

8 Claims, 3 Drawing Sheets

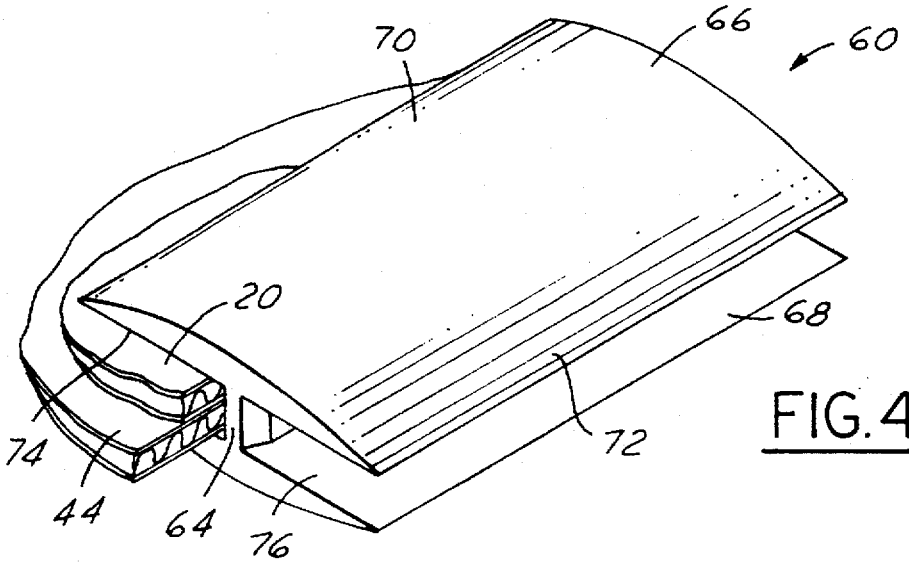
FIG. 4
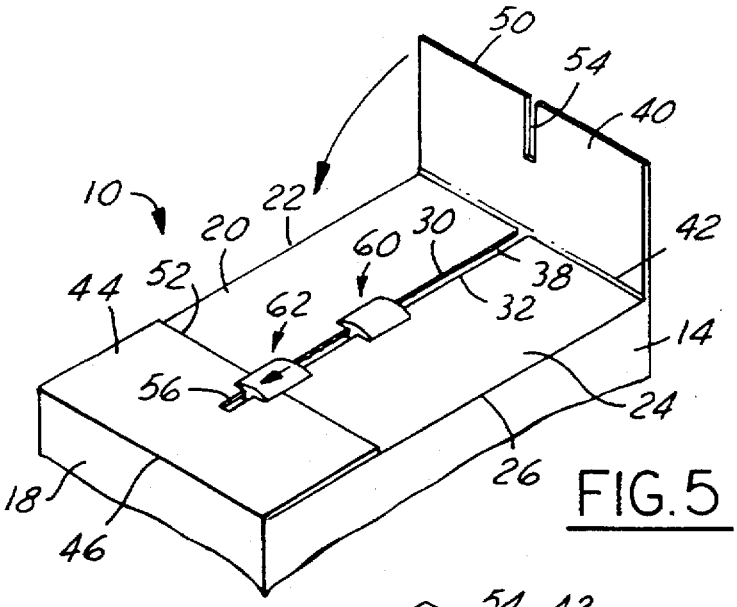
FIG. 5
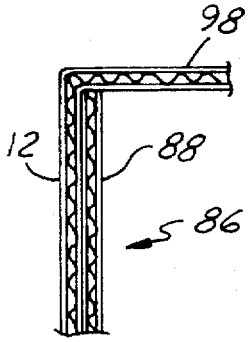
FIG. 8
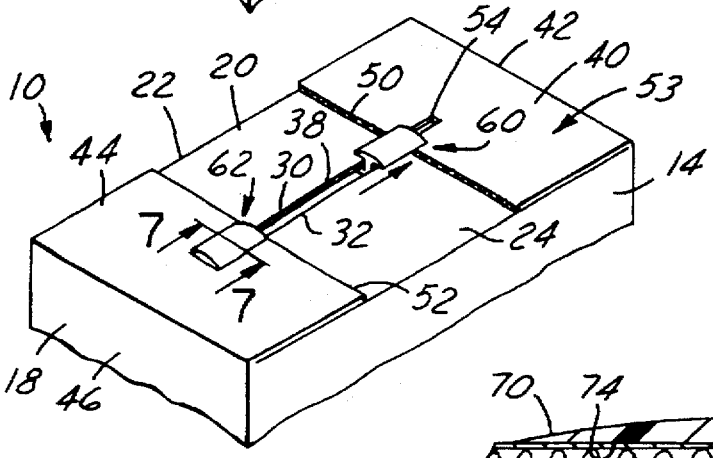
FIG. 6
FIG. 7
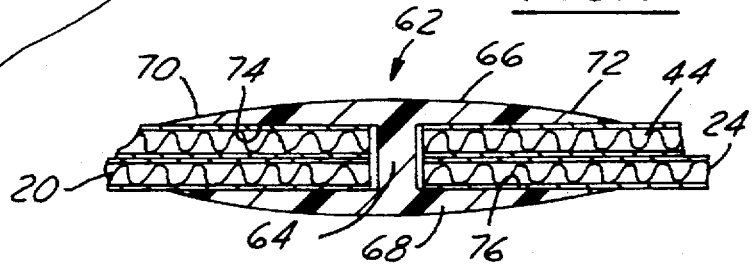

SHIPPING CONTAINER

FIELD OF THE INVENTION

This invention relates generally to shipping containers and more particularly to a shipping container made of fibrous material and having a bottom wall which is capable of being readily opened and closed.

BACKGROUND AND SUMMARY OF THE INVENTION

Shipping containers of the heavy duty type often have inner pallets to support the load. The side walls of the containers are sometimes reinforced with liners to resist outward bulging when the containers are filled with heavy parts. Outward bulging of the side walls is of particular concern when the container is made of cardboard or other fibrous material. Due to the presence of the liners, the pallets are difficult to install and remove.

In accordance with the present invention, the bottom wall of the container is constructed so that it may be readily opened and/or closed, facilitating the installation or removal of the pallet. The bottom wall is made up of flaps, including two flaps foldable inwardly from the lower edges of the side walls of the container to a horizontal position in which their inner edges define an elongated, open-ended channel. Additional flaps fold inwardly from the lower edges of the end walls to horizontal positions underlying the first mentioned flaps, each having a slot which parallels the channel. Two retainers are provided which are slidable in the channel as well as in the two slots to retain the flaps in a closed position. By simply sliding these retainers out of the slots and then removing the retainers through one end of the channel, the flaps are released so that they may be swung outwardly to an open position allowing the pallet to be either installed in the container or removed.

One object of this invention is to provide a shipping container having the foregoing features and capabilities.

Another object is to provide a shipping container which is of simple construction, which is rugged and durable and capable of being re-used many times, and is relatively inexpensive to manufacture and assemble.

These and other objects, features and advantages of the invention will become more apparent as the following description proceeds, especially when considered with the accompanying drawings and claims.

BRIEF DESCRIPTION OF THE DRAWINGS

FIG. 4 is a fragmentary perspective view showing a retainer for the bottom flaps of the container with two of the flaps shown in one of the grooves of the retainer.

FIG. 5 is a fragmentary perspective view of the bottom of the container, showing one of the bottom flaps in the process of being folded to a horizontal, closed position.

FIG. 6 is a view similar to FIG. 5, showing the four bottom flaps folded to the horizontal position closing the bottom of the container, one of the retainers in its final flap holding position, and the other just prior to reaching its final position.

FIG. 7 is a fragmentary sectional view taken on the line 7—7 in FIG. 6.

FIG. 8 is a fragmentary sectional view taken on the line 8—8 in FIG. 1.

DETAILED DESCRIPTION OF THE PREFERRED EMBODIMENT

Figure 1:
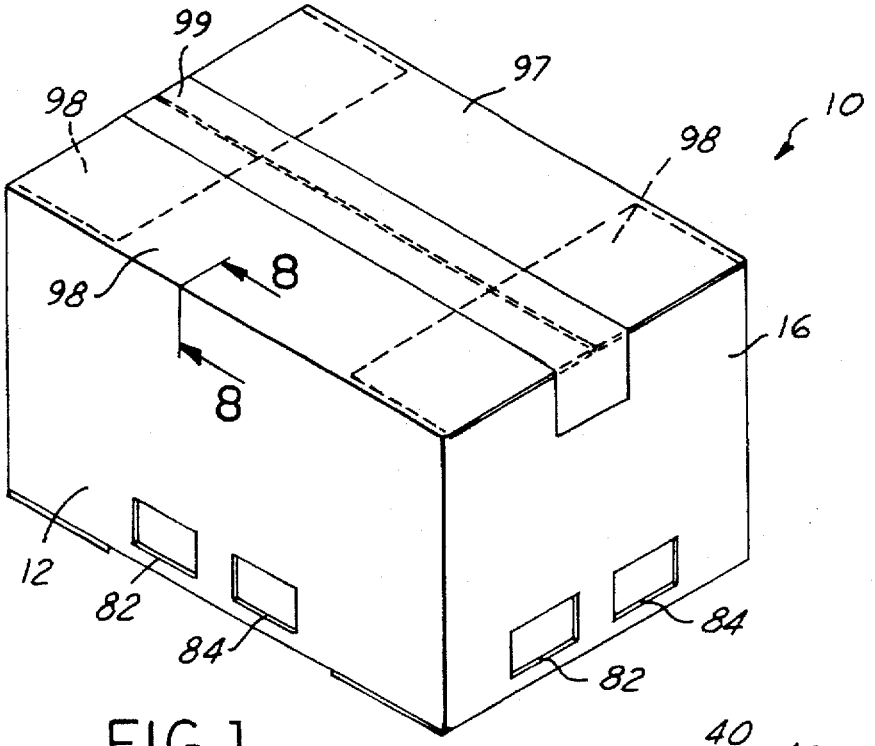
FIG. 1 is a perspective view of a shipping container constructed in accordance with the invention.

Referring now more particularly to the drawings, the container 10 has two laterally spaced-apart vertical side walls 12 and 14 and two laterally spaced-apart vertical end walls 16 and 18. The side walls and end walls are interconnected to one another at the four corners of the container.

A bottom flap 20 is integrally hinged to the lower edge 22 of the side wall 12. A bottom flap 24 is integrally hinged to the lower edge 26 of the side wall 14. The respective bottom flaps 20 and 24 have unattached inner edges 30 and 32 which are parallel to the lower edges of the side walls to which they are connected.

Figure 2:
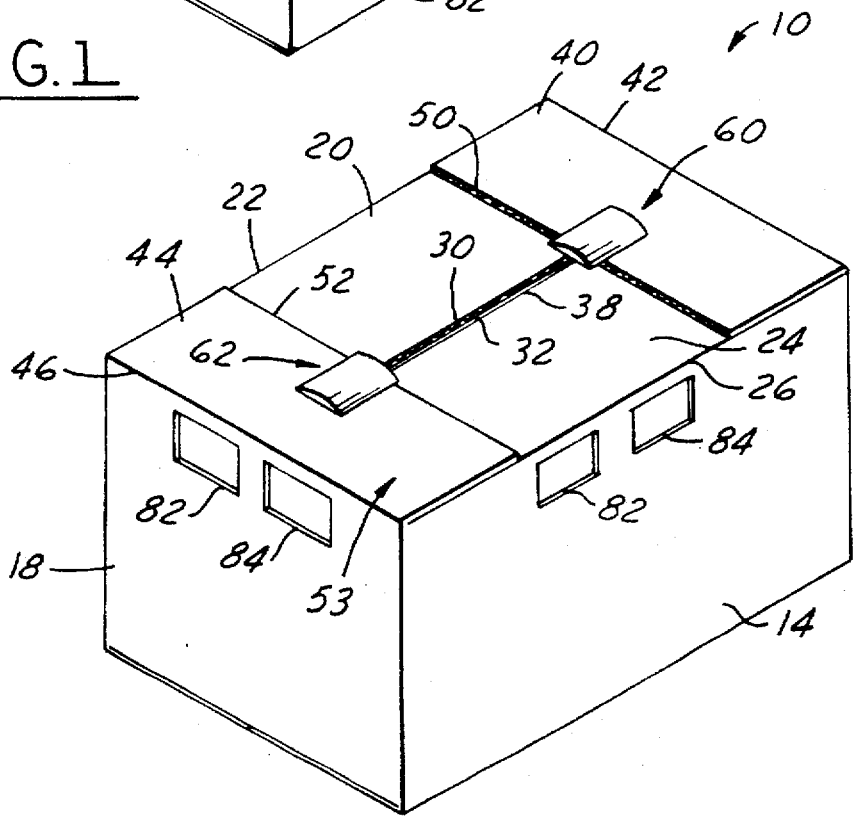
FIG. 2 is a perspective view of the container in FIG. 1 shown inverted.
Figure 3:
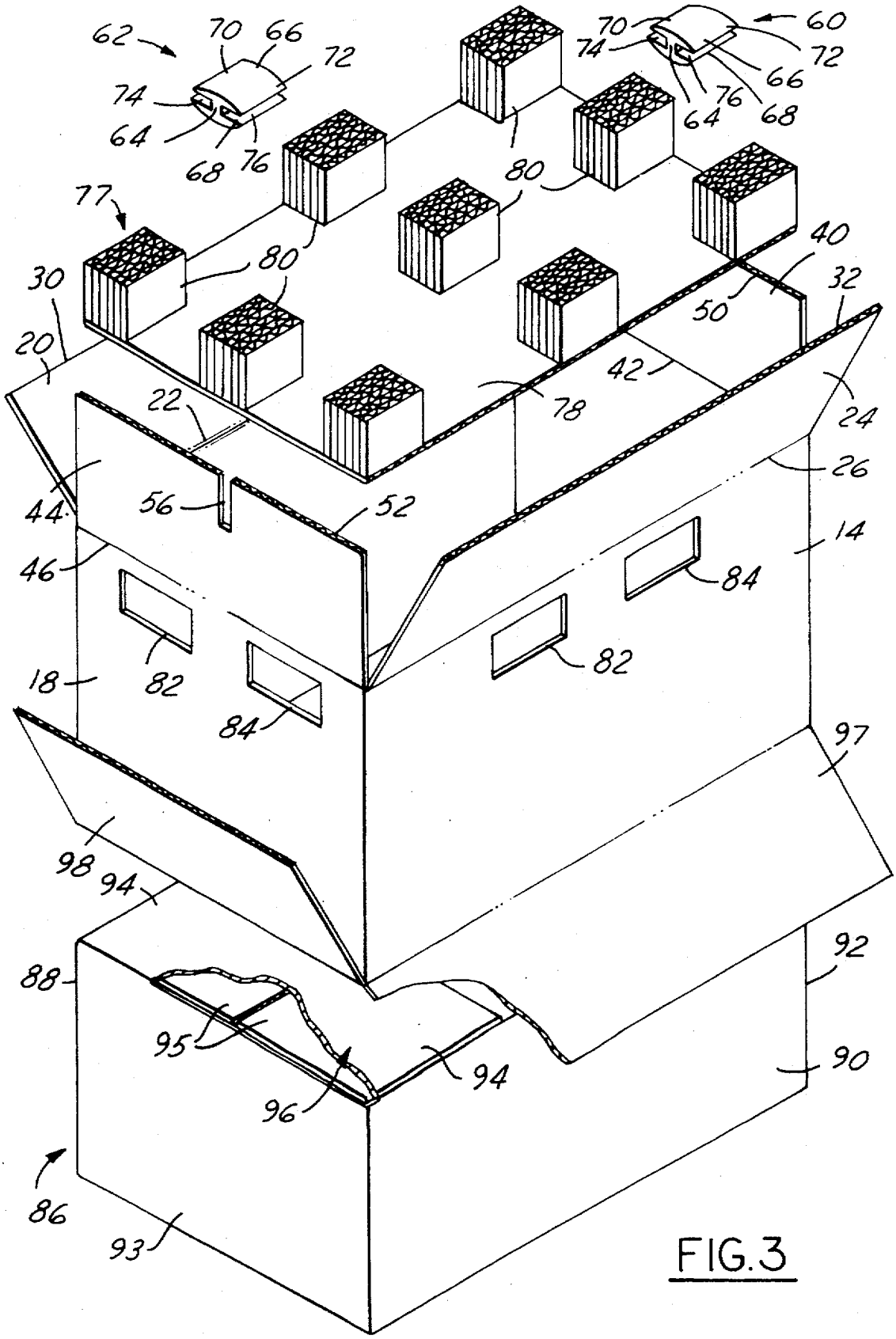
FIG. 3 is an exploded view in perspective of the inverted container.

The bottom flaps 20 and 24 are foldable inwardly from the open positions shown in FIG. 3 to the horizontal positions in FIG. 2 to close the bottom of the container. In the horizontal position, the inner edges 30 and 32 of the flaps are parallel and closely spaced apart to define an elongated, open-ended, narrow channel 38.

A bottom flap 40 is integrally hinged to the lower edge 42 of the end wall 16. A bottom flap 44 is integrally hinged to the lower edge 46 of the end wall 18. The respective bottom flaps 40 and 44 have unattached inner edges 50 and 52 which are parallel to the lower edges of the end walls to which they are connected.

The bottom flaps 40 and 44 are foldable inwardly from the open positions shown in FIG. 3 to the horizontal positions in FIG. 2 in which they underlie the flaps 20 and 24 when the latter are in their horizontal positions. In the horizontal positions of the bottom flaps 40 and 44, the inner edges 50 and 52 of the flaps 40 and 44 are widely spaced apart as seen in FIGS. 2 and 6.

The bottom flaps 20, 24, 40 and 44 together make up the bottom wall 53 of the container.

The bottom flap 40 has a slot 54 extending from the inner edge 50 thereof toward the lower edge 42 of the end wall 16. The bottom flap 44 has a slot 56 extending from the inner edge 52 thereof toward the lower edge 46 of the end wall 18. When the flaps 40 and 44 are folded inwardly to their horizontal positions, the slots 54 and 56 underlie and extend parallel to the channel 38.

The container 10 is preferably made of a fibrous material such as corrugated cardboard and is shown as single ply, but may be multi-ply if desired.

The bottom flaps 20, 24, 40 and 44 are releasably held in the horizontal, closed positions by retainers 60 and 62 which are identical and interchangeable. Each retainer is preferably of integral, one-piece construction and comprises a central body portion in the form of an elongated rib 64, a top horizontal plate 66 and a bottom horizontal plate 68. The plates 66 and 68 extend equal distances beyond opposite sides of the central rib 64 to define side portions 70 and 72 having grooves 74 and 76.

The central rib 64 of each retainer has a width approximating the width of the channel so that it may slide in the channel, with the grooves slidably receiving the inner edge portions of the flaps 20 and 24. The vertical width of the grooves is about twice the width of a bottom flap, so the two bottom flaps can be slidably received therein as will be described more fully below.

To close the bottom of the container 10, the flaps 20 and 24 are first folded inwardly to their horizontal positions, forming the channel 38 between the edges 30 and 32 thereof. The retainers 60 and 62 are then inserted into one end of the channel 38 with the rib 64 of each retainer slidably received in the channel and the inner edge portions of the flaps 20 and 24 slidably received in the grooves 74 and 76. With the retainers moved far enough from one end wall, the end wall 16, for example, to permit inward folding of the flap 40, that flap is folded inwardly to the horizontal position underlying the flaps 20 and 24 with its slot underlying and parallel to the channel. Then the adjacent retainer 60 is slid along channel 38 until its central rib enters the slot 54 in the folded flap 40 and the portions of the flap 40 on both sides of the slot enter the grooves 74 and 76 in the retainer. The same procedure is followed with the other end flap 44 and the other retainer 62 to retain the bottom flaps in the closed horizontal position. The procedure is reversed to open the bottom of the container, first moving the retainers away from the flaps 40 and 44 and out of slots therein to release flaps 40 and 44, and then moving the retainers out of the channel to release the flaps 20 and 24.

A pallet 77 is supported within the container on the bottom flaps 20, 24, 40 and 44. The pallet comprises a rectangular top support member 78 having the stone inside dimensions as the container so that it will fit easily therein. The pallet has spaced legs 80 projecting downwardly from the support member 78 and resting on the bottom flaps of the container. When the bottom flaps 20,24, 40 and 44 are folded outwardly, the pallet may be installed in or removed from the container.

Pairs of laterally spaced-apart openings 82 and 84 are formed in the side walls 12 and 14 and in the end walls 16 and 18 adjacent to the bottom of the container to receive the tines of a fork lift truck whereby the container may be lifted and moved from place to place. The legs 80 of the pallet are spaced apart appropriately to clear the tines of the fork lift when the tines are inserted into the container through any pair of openings 82,84.

A rectangular inner container liner 86 is provided in the container 10, supported on the support member 78 of the pallet. The container liner 86 has substantially the same rectangular configuration as the container 10 but dimensionally somewhat smaller to fit snugly therein with the laterally spaced-apart, vertical side walls 88 and 90 of the container liner 86 engaging and secured as by adhesive to the vertical side walls 12 and 14 of the container 10, and with its laterally spaced-apart, vertical end walls 92 and 93 engaging the inner surfaces of the two vertical end walls 16 and 18 of the container 10 and likewise secured thereto as by a suitable adhesive. The bottom of the container liner 86 is closed by the bottom flaps 94 integrally hinged to the lower edges of the side walls 88 and 90 and the bottom flaps 95 hingedly connected to the lower edges of the end walls 92 and 93. These flaps are folded inwardly to horizontal positions closing the bottom of the container liner 86 forming in effect a bottom wall 96. This bottom wall 96 of the liner rests upon the supporting member 78 of the pallet.

The container liner 86 and the pallet 77 are preferably made of a fibrous material such as corrugated cardboard and are shown as single ply, but may be multi-ply if desired. The upper edges of the side and end walls of the container liner 86 are flush with the upper edges of the side and end walls of the container 10.

The container 10 may, if desired, have top flaps 97 and 98 hingedly connected to the upper edges of the respective side and end walls 12, 14, 16 and 18, adapted to be folded inwardly to horizontal positions closing the top of the container 10 or folded laterally outwardly for access to the contents of the container. A strip 99 of adhesive tape may be applied to the inner edges of the flaps 97 and 98 to seal the container.

I claim:

1. A rectangular shipping container made of fibrous material comprising a pair of laterally spaced-apart vertical side walls and laterally spaced-apart vertical end walls, adjacent ones of said walls being connected to each other, each wall having a lower edge, first and second foldable bottom flaps hingedly connected to the lower edges of the respective side walls, each of said first and second flaps having an unattached inner edge spaced from and parallel to the lower edge of the side wall to which it is connected, said first and second flaps being folded inwardly of the container to horizontal positions in which the inner edges of said first and second flaps are closely spaced apart and define an elongated, open-ended channel, said first and second flaps forming a closed bottom for the container, third and fourth foldable bottom flaps hingedly connected to the lower edges of the respective end walls, each of said third and fourth flaps having an unattached inner edge spaced from and parallel to the lower edge of the end wall to which it is connected, said third and fourth flaps being folded inwardly of the container to horizontal positions underlying the first and second flaps in which the inner edges of the third and fourth flaps are widely spaced apart, said third flap having a first slot extending from the inner edge thereof toward the lower edge of the end wall to which said third flap is connected, said fourth flap having a second slot extending from the inner edge thereof toward the lower edge of the end wall to which said fourth flap is connected, said slots underlying and extending parallel to said channel, a first retainer slidably engaged in said channel and in said first slot and engaging said first, second and third flaps to hold them in their horizontal positions, and a second retainer slidably engaged in said channel and in said second slot and engaging said first, second and fourth flaps to hold them in their horizontal positions, said retainers being slidable in said channel toward one another far enough to withdraw from said slots and release said third and fourth flaps and then slidable out of said channel through either end thereof to release said first and second flaps.

2. A rectangular shipping container as defined in claim 1, wherein each of said retainers has a central body portion fitted in said channel between the inner edges of said first and second flaps, and side portions extending laterally outwardly from said central body portion, each of said side portions having a groove, the grooves in the side portions of said first retainer slidably receiving said first, second and third flaps, and the grooves in the side portions of the second retainer slidably receiving said first, second and fourth flaps.

3. A rectangular shipping container as defined in claim 2, wherein said first and second retainers are I-shaped.

4. A rectangular shipping container as defined in claim 1, wherein said first and second retainers are identical and interchangeable.

5. A rectangular shipping container as defined in claim 1, wherein said retainers are each of integral, one piece construction, and the rest of said container is made of corrugated cardboard.

6. A rectangular shipping container as defined in claim 1, and further including a pallet within said container and resting on said flaps.

7. A rectangular container as defined in claim 6, and further including a rectangular container liner within said container and supported on said pallet.

8. A rectangular container as defined in claim 7, wherein said container liner has side and end walls secured to the side and end walls of said container.

* * * * *